United States Patent [19]

Graham

[11] 4,303,031

[45] Dec. 1, 1981

[54] LINEAR FEED REGULATING CONTROL FOR A SEWING MACHINE

[75] Inventor: Thomas G. Graham, Emerson, N.J.

[73] Assignee: The Singer Company, Stamford, Conn.

[21] Appl. No.: 144,004

[22] Filed: Apr. 28, 1980

[51] Int. Cl.[3] ..... D05B 27/22

[52] U.S. Cl. ..... 112/316

[58] Field of Search ..... 112/121.13, 315, 316

[56] References Cited

U.S. PATENT DOCUMENTS

| | | | |
|---|---|---|---|
| 592,510 | 10/1897 | Parkes | 112/316 X |
| 748,431 | 12/1903 | Smith | 112/316 |
| 1,238,438 | 8/1917 | Rosenman | 112/315 X |
| 3,088,427 | 5/1963 | Bruscaglioni | 112/316 |
| 3,834,334 | 9/1974 | Adams et al. | 112/316 |
| 4,095,540 | 6/1978 | Kaltenbach et al. | 112/315 |
| 4,145,983 | 3/1979 | Law et al. | 112/317 |

FOREIGN PATENT DOCUMENTS

| | | | |
|---|---|---|---|
| 2758599 | 6/1978 | Fed. Rep. of Germany | 112/315 |

*Primary Examiner*—Wm. Carter Reynolds

*Attorney, Agent, or Firm*—William V. Ebs; Robert E. Smith; Edward L. Bell

[57] ABSTRACT

A sewing machine is provided with stitch length control mechanism including a gear rack which is slidably mounted in the base of the machine so that it can be linearly translated to selected positions by an operator, and including a helical gear sector which is operably associated with a feed regulator shaft and meshes with the gear rack at a low helix angle effective to prevent other than operator induced movements of the gear rack.

9 Claims, 6 Drawing Figures

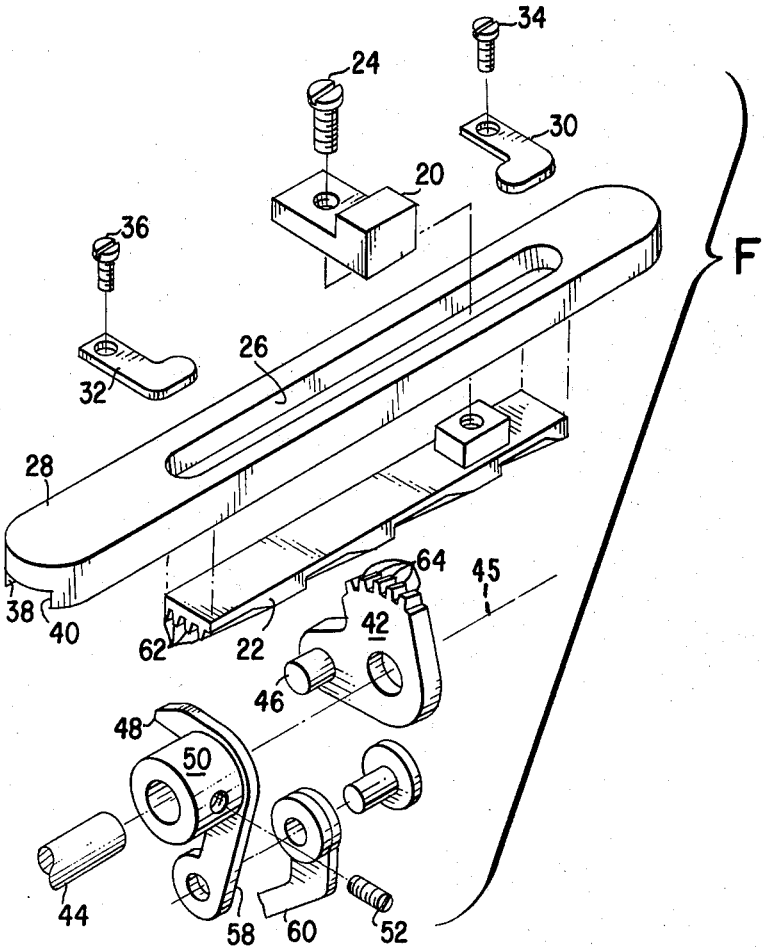
Fig.3
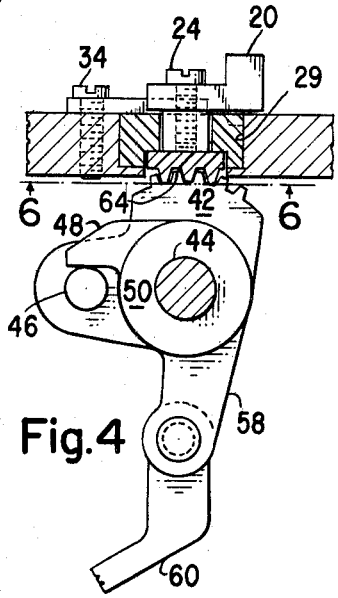
Fig.4
Fig.6
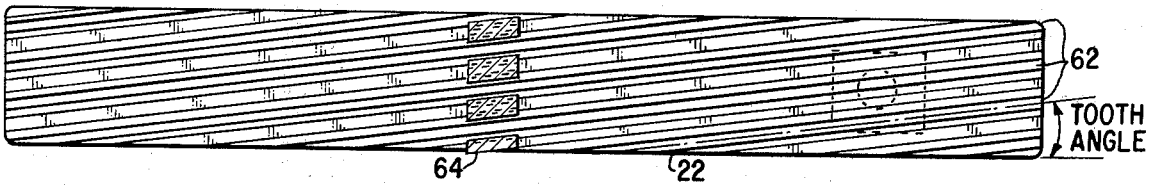
Fig.5
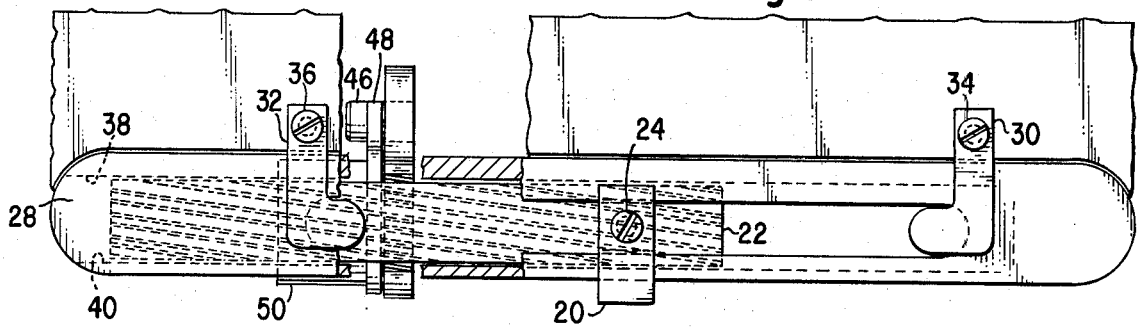

LINEAR FEED REGULATING CONTROL FOR A SEWING MACHINE

DESCRIPTION

Background of the Invention

1. Field of the Invention

The invention relates to sewing machine controls, and more particularly to stitch length controls for sewing machines.

2. Description of the Prior Art

It is common practice to provide a stitch length control dial on the upright post of a sewing machine. However, styling considerations may dictate that the stitch length control be located on the base of the machine. It is also otherwise desirable to have the stitch length control in the base since it is closer at such location to the feeding mechanism to be regulated than when in the post. Dial controls, however, are awkward to manipulate when in the base, and it is therefor preferable at this location to provide a linearly translatable control.

Linear type stitch length controls have been provided heretofor in sewing machines. However, such controls have failed to meet the need for a durable linear control which can be inexpensively constructed from few components and which is reliable in operation. It is a primary object of this invention to provide such a control.

SUMMARY OF THE INVENTION

In accordance with the invention, the bed of a sewing machine is provided with a guide in which a gear rack is slidably received for linear translation to selected positions by an input control member. A gear sector is positionable by the gear rack, and a feed regulator shaft is positionable by the gear sector. The gear rack and gear sector are provided with meshing gear teeth which extend relative to the gears at an angle effective to prevent dislodgement of the gear rack, gear sector and feed regulator shaft from selected positions with the application of less than a predetermined torque to the feed regulator shaft.

BRIEF DESCRIPTION OF THE DRAWINGS

FIG. 3 is an exploded perspective view of the control; FIG. 4 is an end view, partially in section, of said control;

FIG. 5 is a fragmentary top plan view showing the control and a portion of the bed of the machine wherein the control is situated; and FIG. 6 is a sectional view taken on the plane of the line 6—6 of FIG. 5.

DESCRIPTION OF THE INVENTION

Figure 1:
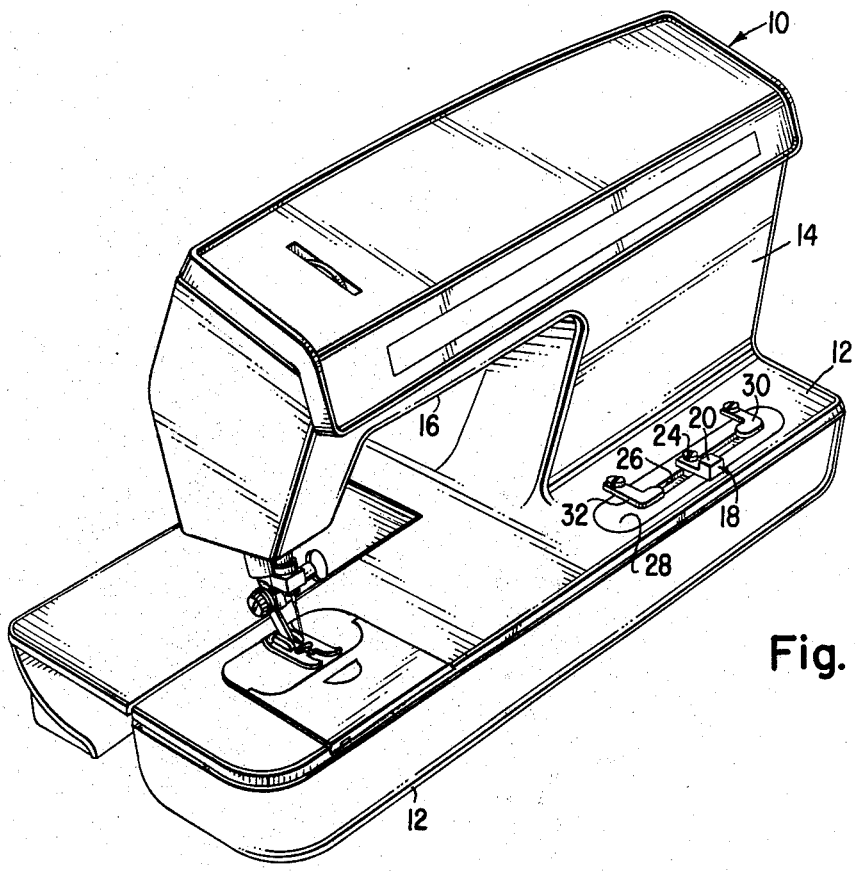
FIG. 1 is a front perspective view of a sewing machine including the linear feed regulating control of the invention.

Referring to the drawings, reference character 10 designates a sewing machine including a bed 12, a standard 14 rising from the bed, and a bracket arm 16 overhanging the bed. A stitch length control 18 in accordance with the invention is provided in the bed 12.

The stitch length control 18 includes an input stitch length selecting control knob 20, and an elongated gear rack 22 to which the control knob is affixed as by a screw 24. As shown, input control knob 20 projects upwardly through a slot 26 in a guide plate 28 which nests in a recess 29 in the bed. The guide plate 28 is retained in the bed by a pair of adjustable stops 30 and 32 which overlap the plate and are fastened to the bed with screws 34 and 36, respectively. The stops are engageable with control knob 20 and define extreme positions therefor. Opposite sides 38 and 40 of guide plate 28 define a track for the gear rack 22 which is slidable therein under the plate 28.

The stitch length control includes a gear sector 42 which is positionable by the gear rack 22 and further includes a feed regulating shaft 44 which is positionable by the gear sector. The control knob 20 and gear rack 22 move linearly, whereas the gear sector 42 and shaft 44 move in a rotational sense about an axis 45 extending substantially parallel to the direction of linear movement of the rack. The position of the feed regulator shaft determines the operation of work feeding mechanism, such as disclosed for example in U.S. Pat. No. 4,145,983 of The Singer Company for "Feed Regulating Mechanism for a Sewing Machine", but not repeated here.

Gear sector 42 is mounted for rotational movement on the feed regulating shaft 44 and is provided with a fixed laterally extending pin 46. The pin 46 is engageable with a lever arm 48 which extends from a collar 50 that is secured to the feed regulating shaft with set screw 52. Reference character 56 designates a torsion spring provided to exert a torque on shaft 44 and so bias lever arm 48 on collar 50 toward pin 46. A second lever arm 58 may be provided on the collar 50 to connect the collar through a link 60 to cam controlled mechanism such as shown for example in the aforesaid U.S. Pat. No. 4,145,983.

Figure 2:
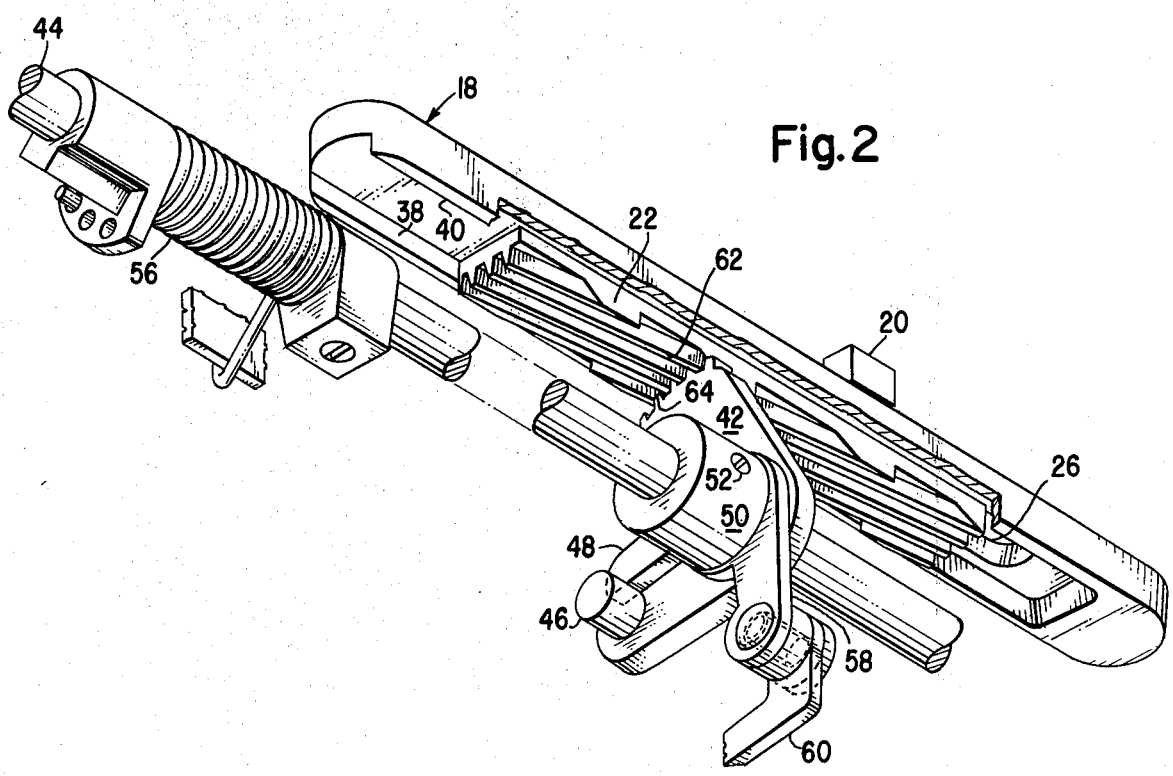
FIG. 2 is an enlarged bottom perspective view of the feed regulating control.

The input control knob 20 is selectively positionable between a position against stop 32 calling for maximum stitch length and a position against stop 30 calling for minimum stitch length. When control knob 20 is moved away from stop 30 and toward stop 32, gear rack 22 is linearly translated to the left as viewed in FIGS. 2, 3, 5 and 6, and a clockwise rotational movement is imparted to gear sector 42 by the rack 22. Pin 46 acting against lever arm 48 on collar 50 results in a clockwise rotational movement of the collar 50 and feed regulating shaft 44 to which the collar is affixed, the shaft being so positioned as to increase stitch length. When control knob 20 is moved away from stop 32 and toward stop 30, gear rack 22 is linearly translated to the right and a counterclockwise rotational movement is imparted to gear sector 42 by rack 22. The biasing effect of spring 56 maintains lever arm 48 on collar 50 in contact with pin 46 as the gear sector moves in a counterclockwise direction. The collar 50 and feed regulating shaft 44 therefor move in a counterclockwise direction, and the shaft is positioned to decrease stitch length.

As noted hereinbefore, the stops 30 and 32 are adjustable. Adjustments are effected by loosening the screws 34 and 36 and pivoting the stops into desired positions after which the screws are tightened to retain the stops in the selected positions. In this way the extent of permissible movement of control knob 20 and the range over which stitch length may be varied is determined.

The collar 50 and feed regulating shaft 44 may be moved cyclically against the biasing force of torsion spring 56 by cam controlled mechanism acting through link 60 on lever arm 58. Such motion of collar 50 in which lever arm 48 is lifted off pin 46, and of shaft 44 is in a direction resulting in a decrease in stitch length and may for example, be of sufficient magnitude to produce a reverse feed movement of material being sewn on the machine 10. Between the movements of shaft 44 in the direction to decrease stitch length, the shaft would be moved in the direction to increase stitch length by the spring 56 to the limiting position defined by the reengagement of lever arm 48 with pin 46. In this manner, patterns with varying stitches may be sewn automatically on the machine.

Gear rack 22 and gear sector 42 are formed with meshing helical gear teeth 62 and 64, respectively, which extend relative to the axis of the gear sector at an angle sufficiently acute to prevent less than a predetermined reverse torque on the feed regulating shaft, due to the spring 44 and vibrational forces, from dislodging the gear rack 22 from any position in which it may have been placed with the control knob, but not so acute as to require excessively long linear control movements of the gear rack, not easily accommodated in the machine. The selected angle for the helical gear teeth is preferably within the range of 5° to 15° for a control of the type described in association with cam controlled feeding mechanism requiring the use of a spring such as the spring 44. For a control not associated with cam controlled feeding mechanism and therefor not including a collar 50, but having the gear sector 42 affixed to a feed regulating shaft which is not spring biased, selected positions of the gear rack may be maintained with a greater angle between the helical teeth and axis of the gear sector.

The invention has been disclosed herein in preferred forms. However, it should be understood that various changes in the details, materials, arrangement of parts and operating conditions which have been herein described and illustrated in order to explain the nature of the invention, may be made by those skilled in the art within the principles and scope of the invention.

I claim:

1. In a sewing machine, stitch length control mechanism including a linearly movable input control member, a linearly translatable gear rack selectively positionable by the input member, a gear sector positionable by the gear rack about an axis of rotation extending substantially parallel to the direction of linear translation of the gear rack, and a feed regulator shaft positionable by the gear sector, the gear rack and gear sector having meshing helical gear teeth extending relative to the axis of the gear sector at an angle effective to prevent dislodgement of the gear rack, gear sector and feed regulator shaft from selected positions with the application of less than a predetermined torque to the feed regulator shaft.

2. The combination of claim 1 wherein the bed of the sewing machine includes a guide in which the gear rack is slidably received for linear translation.

3. The combination of claim 2 including adjustable stops for limiting movement of the gear rack.

4. The combination of claim 3 wherein the adjustable stops are engageable with the input control member.

5. In a sewing machine, stitch length control mechanism including an input control member, a linearly translatable gear rack selectively positionable by the input member, a gear sector positionable by the gear rack, a feed regulator shaft, a gear sector rotatably mounted on the feed regulator shaft and positionable by the gear rack, a collar affixed to the feed regulator shaft, a pin affixed to the gear sector for movement thereby, a lever arm on the collar engageable by the pin for imparting rotational movement to the collar and feed regulator shaft, and spring means which is operably associated with the feed regulator shaft and biases said lever arm against the pin, said gear rack and gear sector having meshing helical gear teeth extending relative to the axis of the gear sector at an angle effective to resist the biasing force of the spring means and prevent dislodgement of the gear rack from a selected position.

6. The combination of claim 5 including means operably connected with said collar for moving the collar and feed regulator shaft in a direction causing the lever arm to move away from the pin.

7. The combination of claim 5 wherein said angle is within the range of five to fifteen degrees.

8. The combination of claim 5 wherein the bed of the sewing machine includes a guide which defines a track for the gear rack.

9. The combination of claim 8 wherein the guide includes a slot and the input control member extends through said slot.

* * * * *